United States Patent [19]

Stavis

[11] Patent Number: 4,614,317

[45] Date of Patent: Sep. 30, 1986

[54] SENSOR FOR ANTI-TANK PROJECTILE

[75] Inventor: Gus Stavis, Wayne, N.J.

[73] Assignee: The Singer Company, Little Falls, N.J.

[21] Appl. No.: 742,661

[22] Filed: Jun. 7, 1985

[51] Int. Cl.[4] ..... F42B 15/02; G01S 9/22

[52] U.S. Cl. ..... 244/3.19; 102/214; 343/16 M

[58] Field of Search ..... 102/214, 213, 476; 244/3.19, 3.15, 3.21, 3.24, 3.1; 343/7 PF, 16 M

[56] References Cited

U.S. PATENT DOCUMENTS

| | | | |
|---|---|---|---|
| 2,925,965 | 2/1960 | Pierce | 102/213 |
| 2,998,942 | 9/1961 | Kuck | 244/3.19 |
| 3,067,681 | 12/1962 | Beman | 244/3.19 |
| 3,072,055 | 1/1963 | Ross | 244/3.16 |
| 3,844,506 | 10/1974 | Stavis et al. | 244/3.19 |
| 4,160,415 | 7/1979 | Cole | 102/214 |
| 4,160,974 | 7/1979 | Stavis | 244/3.19 |
| 4,238,090 | 12/1980 | French | 244/3.19 |
| 4,242,962 | 1/1981 | Wakeman et al. | 102/213 |
| 4,546,940 | 10/1985 | Andersson et al. | 244/3.1 |

*Primary Examiner*—Charles T. Jordan

*Attorney, Agent, or Firm*—Thomas W. Kennedy

[57] ABSTRACT

A radar sensor mounted in a projectile detects a target and orients the projectile so that a self-forging fragment, carried in the projectile, may be properly fired toward the top of the target. The sensor provides means for generating a broad fan beam containing a plurality of closely spaced interference lobes spaced so as to encompass a predetermined target size. The interference lobes are continuously swept across the line of travel and the receiving circuitry provides means for detecting the desired target within the interference lobes.

12 Claims, 8 Drawing Figures

SENSOR FOR ANTI-TANK PROJECTILE

FIELD OF THE INVENTION

The present invention relates to a radar sensor and more particularly to such a sensor employed in a projectile homing device.

BACKGROUND OF THE INVENTION

U.S. Pat. No. 4,160,974, which issued to the present inventor and assignee on July 10, 1979, set forth the desirability of providing a target seeker and homing sensor which is low cost, lightweight, and capable of detecting the presence and direction of a discrete target, such as a tank. The target-seeking system of the patent was suitable for use in a mini-drone aircraft. Information from radar detectors mounted in the aircraft searched for targets and, upon detection, provided guidance signals to steer the aircraft into the target.

Although the prior patent operates satisfactorily in a number of strategic situations, it has been found that armored vehicles, such as an armored tank, have most resistance to projectiles fired at their front and sides. The top of a tank is usually least armored. As a result, destruction of such a target is most likely if a ballistic body could be fired directly at the top surface of the tank. An existing armament consists of a self-forging fragment which has an extremely high kinetic energy and has demonstrated the capability to penetrate heavy armor. By improving the system of the mentioned patent, an effective weapon control system results which permits maximum utilization of a self-forging fragment. In a preferred embodiment of the invention, a projectile is fired over a target tank so that the projectile passes over it at an altitude typically between 50 feet–200 feet. Normally, such a round is spinning at several hundred revolutions per second, the spin being imparted by the gun barrel rifling. For this invention, the spin is a non-permissible condition and, therefore, means are provided to reduce the spin to zero prior to firing of the projectile contained self-forging fragment. The inventive sensor consists of a radar, preferably operating as a millimeter wave radar having a distinctive antenna pattern and which will perform the functions of determining the spin rate of the projectile, the approximate vertical direction, detection of the target, measurement of range and direction to the target and providing the detonating signal to fire a self-forging fragment at an appropriate time.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

In order to best understand the present invention, an explanatory application will be discussed in connection with the utilization of the present invention in a weapon control system for an anti-tank projectile. However, as will be appreciated at the end of the discussion, the invention has a wide application for weapon systems in various types of projectiles. In an application for anti-tank use, it should be first stated that an armored tank has most resistance to projectiles fired at its front and sides. The top of the tank is usually least armored. Self-forging fragment ballistic bodies have long been recognized for their ability to combat armored vehicles due to their extremely high kinetic energy and armor penetration ability. It is to be understood that self-forging fragments, in themselves, are not what is claimed as the present invention.

Figure 1:
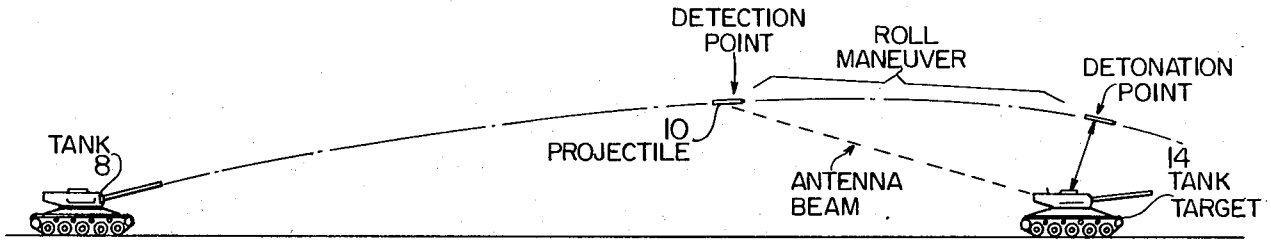
FIG. 1 is a pictorial sketch of the trajectory followed by a projectile of the present invention.

The present invention deals with a radar sensor capable of aiming and detonating a ballistic body, such as a self-forging fragment when the fragment and sensor are carried within a projectile passing over a target, such as a tank. For example, one application of the present invention is a 105 mm tank-fired round (projectile) which would be fired from a vehicle such as tank 8, as shown in FIG. 1. The projectile 10 would be fired over a target tank 14 and pass over it at an altitude typically between 50–200 feet. Normally, such a round is spinning at several hundred revolutions per second, the spin being imparted by gun barrel rifling occurring at attacking tank 8. For the particular anti-tank application to be discussed herein, such spin cannot be tolerated so that means must be provided to reduce the spin to zero. One mechanical means for doing this is to provide slip rings on the projectile to decouple it from the gun barrel rifling so that a minimum spin is imparted to it at the beginning of the trajectory of the projectile. However, as the projectile approaches the target, it is essential to reduce the spin, substantially to zero. The present inventive sensor would be located in projectile 10 and has a transmitted radar pattern which performs the function of determining the spin rate of the projectile, the approximate vertical direction between projectile 10 and tank target 14, measurement of range and direction of the tank target 14, and controlling detonation of a self-forging fragment.

Figure 2:
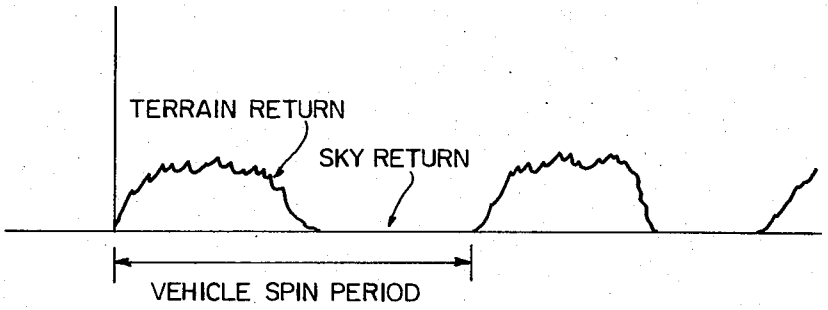
FIG. 2 is a plot of a radar return showing differing signals, received by the radar, from terrain versus sky.
Figure 7:
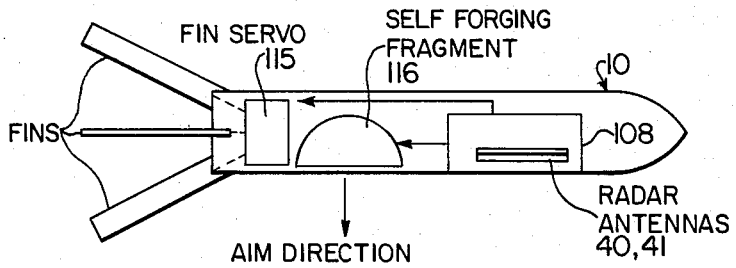
FIG. 7 is a schematic illustration of the internal components contained within a projectile, as employed in the present invention.

With continued reference to FIG. 1, the range between an attacking tank 8 and a tank target 14 may be in the order of 10,000 feet. As fired projectile 10 emerges from the gun barrel of tank 8, it will be spinning as previously mentioned. An antenna beam generated by the radar sensor in projectile 10 may be directed at 45 degrees from the projectile axis as illustrated so that, as the projectile spins and approaches the target, the transmitted beams will alternately be directed at the sky and the ground. A resulting radar signal will therefore appear as shown in FIG. 2. The earth/sky waveform of FIG. 2 will provide the information for de-spinning the projectile by generating an error signal in a fin servo, such as shown in FIG. 7, the latter controlling stabilizing fins of the projectile 10, shown diagrammatically in FIG. 7. The generated error signal is minimized as the spin is reduced substantially to zero. The specific mechanical means for implementing the fin displacement is not the present invention, per se, since methods for stabilizing fin mechanisms, per se, are well known in the art.

Figure 3:
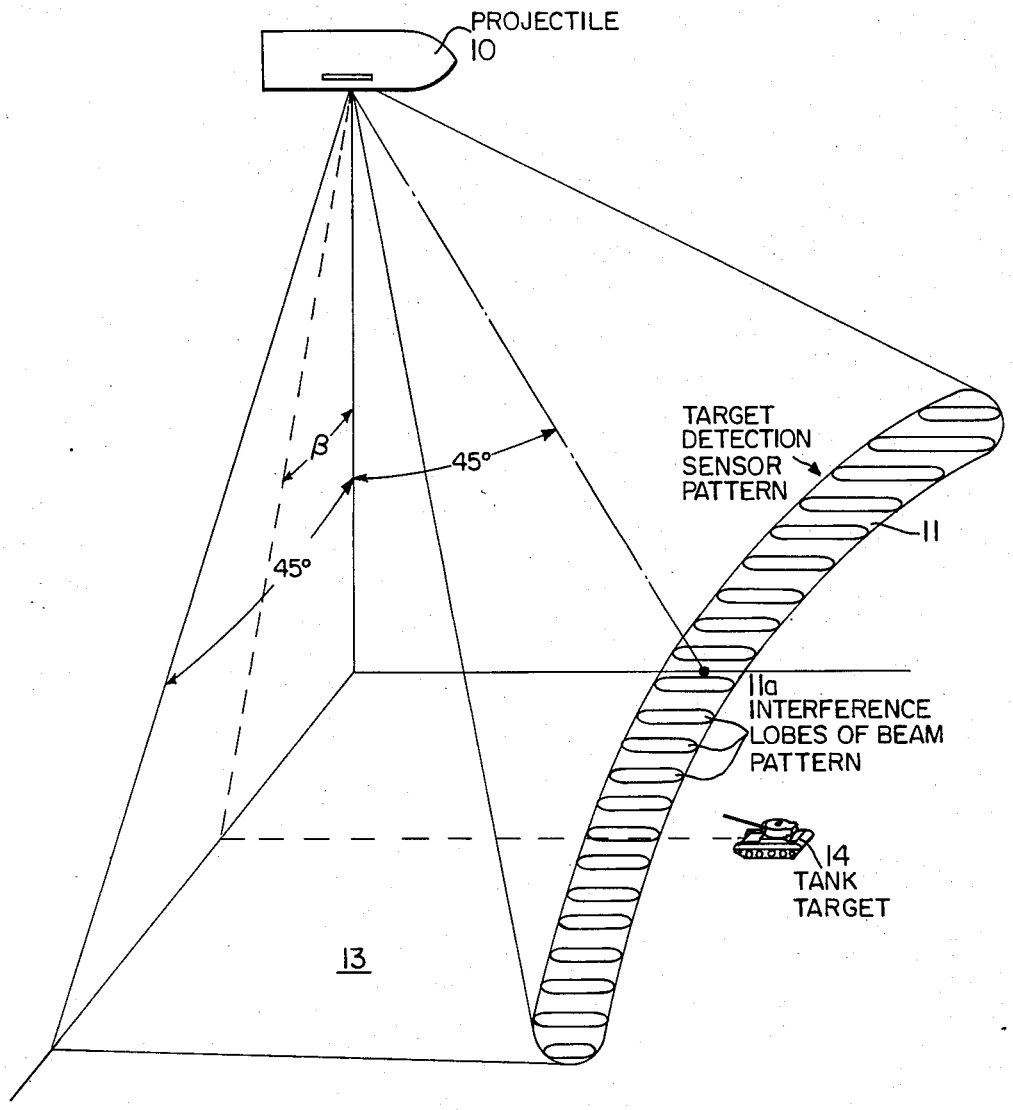
FIG. 3 is a three-dimensional representation of the general antenna beam configuration of the present invention.

Referring to FIG. 3, there is shown the target detection beam 11 directed from projectile 10. The philosophy of the present system involves searching an area of ground 13 generated by the total width of the detection pattern and by the forward motion of projectile 10. When a target tank 14 falls within beam 11, its presence and angular location $\beta$ along the width of the beam will be determined. The shape of beam 11 in space will be a section of a conical shell so that its intersection with the ground is a hyperbola.

The antenna pattern is actually two sets of patterns, namely, a closely spaced set of interference lobes 11*a* shown in FIG. 3 contained within the broad fan detection beam 11 which, as will be explained later, is actually a monopulse set of beams. The dimensions of the fan beam are such as to sweep the area immediately in front of projectile 10 with a width sufficient to ensure inclusion of the tank target 14 despite aiming errors and errors due to the dispersion of the rounds. The purpose of the lobes 11*a* is to provide some significant discrimination against clutter and to provide precise measure of the transverse angle to the target ($\beta$).

Figure 4:
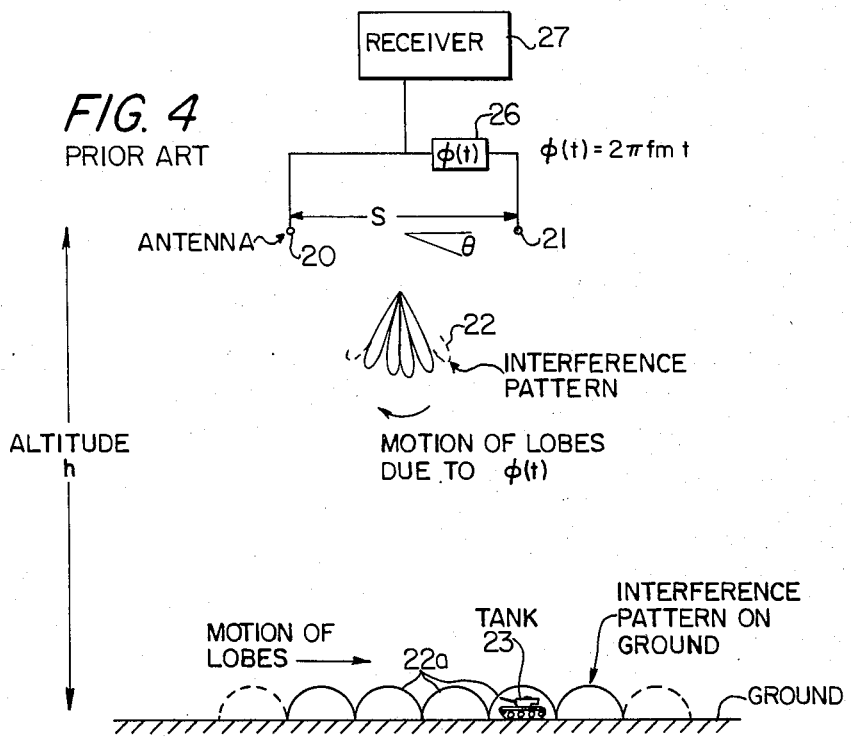
FIG. 4 PRIOR ART
FIG. 4 shows the interference pattern generated by a pair of isotropic antennas separated by a known distance.

The nature and reason for the interference pattern will be described with reference to FIG. 4 which illustrates a prior art receiver as discussed in the aforementioned U.S. Pat. No. 4,160,974. At the top of FIG. 4, there is shown a pair of antennas 20 and 21 separated by a distance, S, equal to many wavelengths so that a multilobed interference pattern 22 is generated. The spacing S is chosen on the basis of having the illustrative tank target 23 substantially fill a lobe 22*a* at the chosen altitude h. Next, consider that the two antennas 20 and 21 are tied together through a continuously varying phase shifter 26, which introduces a time variant phase $\phi(t)=2\pi f_m t$, so that the interference pattern is moved along in the direction of the arrow to scan the ground. The received signal from tank target 23 will be modulated at frequency ($f_m$) by the movement of lobes 22*a*. Furthermore, the depth of modulation will be large because the lobe size is chosen to be optimum for the tank target. The scanning interference pattern is in essence a spatial filter and will favor responses from a narrow range of target sizes.

The scanning lobe benefit permits a simultaneous and very rapid scan of a wide angle across the ground track by merely shifting the phase between the antennas, while offsetting the beam dilution loss suffered because the target does not fill the beam.

The transverse extent of the set of lobes depends on the beam width of the individual antennas 20 and 21. At an altitude h above ground, the individual lobes will have a definite width of footprint which can be selected to be equal to the size of the target. If a target tank 23 substantially fills a single lobe footprint as shown, then it will provide a large echo. If it should lie in a null of the pattern, then the return echo will be a minimum. If these lobes can be made to traverse the tank target at a high rate, then the radar echo will be modulated at that rate as each lobe crosses the tank. Objects (such as buildings, terrain clutter, etc.) which are larger than the lobe footprint will yield much lower modulations. This, therefore, provides some significant size discrimination or spatial filtering.

Figure 5:
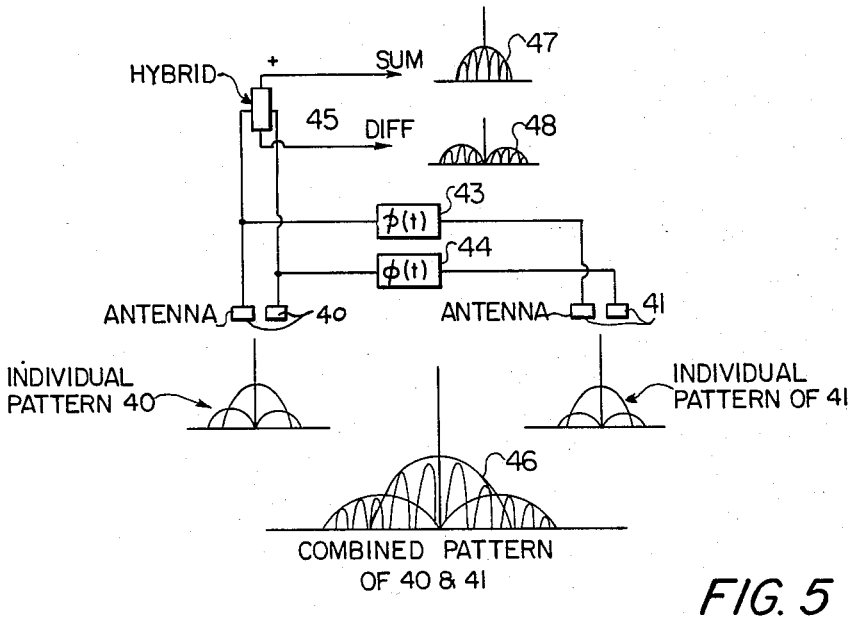
FIG. 5 PRIOR ART
FIG. 5 shows antenna pairs for generating a monopulse array.

As previously mentioned, the lobes can be made to traverse the ground track by changing the phase of one antenna relative to the other. Phase shifter 26 achieves this function and, if the shifter continuously retards the phase of antenna 21 at a rate equal to $\phi(t)$, then the lobes will appear to move to the right in a continuous fashion. If $\phi(t)$ is 360 degrees/microsec, then the modulation from the tank will be at 1 MHz. The phase angle of this 1 MHz signal relative to the transmitted phase $\phi(t)$ will provide a precise measure of the angle $\beta$ to the target. However, because of the multiplicity of the lobes, it becomes necessary to eliminate the ambiguity due to aliasing within each lobe. This can be done by adding a monopulse pattern to this antenna, which can provide resolution of the aliasing ambiguities as shown in FIG. 5. In this case, the antennas previously referred to by 20, 21 in FIG. 4 are made up of pairs 40, 41, which convert each to the possibility of generating sum and difference patterns. Antenna pairs 40 and 41 acting together will still have the fine lobe structure previously described but the envelope pattern, within which these fine lobes are contained, will be the monopulse pattern 46 associated with each antenna group 40 and 41. Now if a tank target is contained within the beam, both the sum output 47 and the difference output 48 from the hybrid circuit 45 will contain the target signal at frequency f (the scanning lobe rate produced by phase shifters 43 and 44). The ratio of the difference to sum signal amplitudes will be a coarse measure of the angle away from ground track to the target. This is the angle $\beta$ in FIG. 3. Thus, means are provided for detecting the presence of a target and for determining its location along the width of the beam. In the example previously given, the 1 MHz modulation will be present in both the sum and difference patterns; but by measuring the ratio of the amplitude of the 1 MHz in the sum to that in the difference pattern, the approximate angle to target can be determined. The precision refinement in the measurement is obtained via the phase measurement of the 1 MHz signal.

Figure 6:
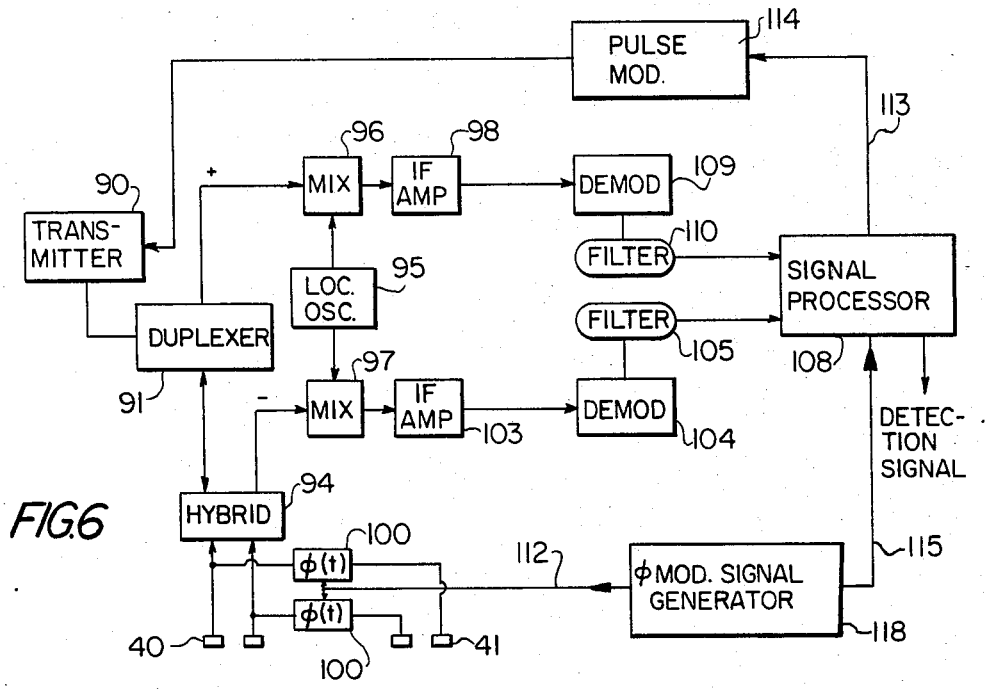
FIG. 6 is a block diagram of the present target sensor.

The block diagram of FIG. 6 illustrates an improvement of the present radar system over the previously mentioned U.S. Pat. No. 4,160,974. Connected between antennas 40 and 41 are dual phase shifters 100 driven by a signal processor 108. The signals received by the antennas and modulated by the phase shifters are fed to hybrid circuit 94 which in turn provides a sum output to mixer 96 and a difference output to mixer 97. In these mixers the received signals are combined with signals from local oscillator 95 to generate a sum IF signal to be applied to IF amplifier 98 and a difference IF signal to be applied to IF amplifier 103. The outputs of the IF amplifiers are applied to respective demodulators 109 and 104 and the demodulated signals are then respectively filtered by 110 and 105. The output from filters 110 and 105 extract amplitude and phase information of the scanning lobe modulation. As previously mentioned, this 1 MHz modulation will be present in both the sum and difference patterns, but when the signal processor 108 measures the ratio of the 1 MHz amplitude in the sum to that in the difference pattern, the approximate angle to the target can be determined. The phase modulation signal generator 118 provides the phase modulation signal to respective inputs of the phase shifters 100 via line 112 and to the signal processor 108 via line 115. A duplexer 91 allows the flow of power from transmitter 90 to the antennas and precludes the flow of direct transmitter power to the mixer 96. It also allows the flow of received echo signal to the mixer 96 and excludes such signal from flowing to transmitter 90. The signal processor 108 may be a conventional microprocessor capable of triggering pulse modulator 114 which generates short pulses having a high pulse repetition frequency. By pulsing transmitter 90 with such pulses, range to the target can be determined by measuring echo delay time in the signal processor.

As a design consideration the pattern in the vertical longitudinal plane of the antennas 40 and 41 may be made very narrow by making the antennas in the form of linear arrays mounted on the sides of the projectile 10. The vertical pattern width is determined by the length of these arrays.

In order to understand how the system of the projectile functions, the system operation will now be discussed. Again referring to FIG. 1, the projectile 10 is initially fired to pass over the target tank 14. The spin imparted to the projectile is reduced initially by the use of slip rings to a relatively low value. The sensing system of the present invention is energized and senses the projectile rotation in terms of the earth/sky return as shown in FIG. 2. The return, as picked up by radar antennas 40 and 41, is processed by the signal processor 108 and, as shown in FIG. 7, the output from the signal processor is fed to fin servo 115 to adjust the fins which will de-spin the projectile. By measuring and minimizing the average range to the terrain as a function of vehicle roll attitude, an approximate normal to the terrain can be determined to orient the projectile so that the self-forging fragment 116, enclosed within projectile 10, is pointed generally downward.

The projectile 10 continues its flight and maintains its attitude by sensing the terrain in this manner. The antenna lobes scan the surface for a target tank 14. It may be desirable to arm the sensor at a predetermined range from the gun so as to reduce the possibility of false alarms during the early part of the flight. This, of course, could be done in a rather elementary way by the signal processor 108.

Figure 8:
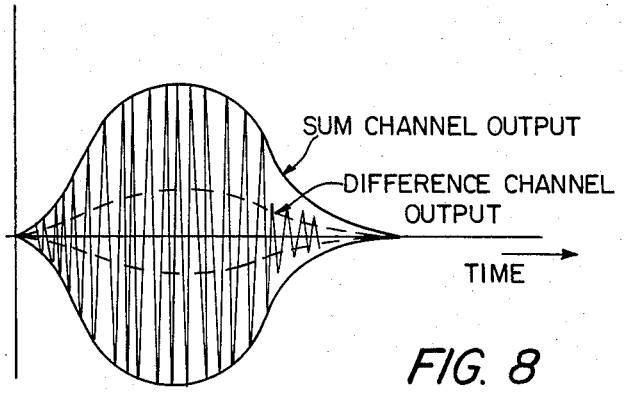
FIG. 8 is a plot of sum and difference channel output as a function of time.

The sensor will sense target 14 when the antenna beam sweeps across it as shown in FIG. 3. Utilizing the numbers cited by way of example only, the signal will consist of a 1 MHz signal in both the sum and difference channels of the receiver. If the projectile is moving at 2,000 feet per second and if the vertical beam width angle is quite small, then the dwell of the beam on the tank is approximately equal to the length of the tank divided by projectile velocity which, in the example used, is equal to 20 ft/2,000 ft per second equals 0.01 second. Thus, the 1 MHz output will exist for about 10 milliseconds. This will be the duration of the composite pulses shown in FIG. 8.

The 1 MHz signal from each channel is processed for the following:

(a) phase of the 1 MHz to get roll angle to target;

(b) ratio of difference to sum amplitude to resolve aliases;

(c) range to target.

The processor 108 is provided with this data so that it can compute the time to target in order to detonate the self-forging fragment. The processor also computes the time at which a thruster must be fired to roll the projectile 10 a proper amount so that the fragment is aimed at it.

All of the aforementioned computations made by the signal processor 108 are well known in the art. However, it is the combination of these steps in the present application which renders the present system inventive.

The roll to achieve aim at the target will be produced by firing a fixed thruster reducing either clockwise or counterclockwise spin at a time such that fixed thruster impulses will cause a predetermined roll rate to point the fragment at the aimed point at the right instant. The time of detonation will be computed from the range and roll angle.

It should be understood that the invention is not limited to the exact details of construction shown and described herein for obvious modifications will occur to persons skilled in the art.

I claim:

1. A weapon control system comprising:

a projectile having an electronics storage space therein;

signal processing means located in the storage space;

means located in the storage space for transmitting a radar interference beam pattern toward the ground in order to detect a target;

means located in the storage space for receiving ground reflections in response to the transmitted beam;

movement of the interference beam across a target causing the receiving means to detect modulation of the interference pattern;

the processing means processing the modulation detected by the receiving means, indicative of a target, and adjusting the roll position of the projectile to a preselected orientation and;

a ballistic body stored within the storage area and oriented in confronting vertical relationship to the target when the position of the projectile assumes the preselected orientation so that the ballistic body may be fired to intercept the target.

2. The projectile set forth in claim 1 together with means connected between the processing means and fin control means of the projectile for adjusting the position of projectile fins to slow the rate of projectile spin so as to achieve the preselected projectile orientation when it approaches a target.

3. The projectile set forth in claim 2 wherein the ballistic body is a self-forging fragment.

4. A target sensor for a projectile comprising:

a pair of antennas and a transmitter connected thereto for transmitting a broad fan beam containing a plurality of closely spaced interference lobes, said lobes being spaced so as to encompass a predetermined target size;

said antennas receiving echo signals from targets present in said interference lobes and delivering said signals to a receiver;

means interconnected between said transmitter and receiver for preventing transmitted signals from entering said receiver during transmitting periods and for permitting reception of said echo signals in said receiver during receiving periods;

means connected to the antennas for continuously varying the position of said interference lobes;

means responsive to said antennas for developing sum and difference signals;

a first mixer stage in said receiver for receiving the sum output signal;

a second mixer stage in said receiver for receiving the difference output signal;

a local oscillator in said receiver providing outputs to said first and second mixer stages for generation of sum and difference intermediate frequency signals;

first and second intermediate frequency amplifier means respectively connected to the outputs of the mixer stages;

means serially connected to each output of said first and second intermediate frequency amplifier means for demodulating the sum and difference intermediate frequency signals;

and signal processing means connected in circuit with the demodulating means for measuring the ratio of the sum and difference signals to provide an output signal representing the angle between the projectile and a target;

means connected between an output of the processing means and the transmitter for pulsing the transmitter which enables target range to be determined by the processing means by measuring echo time of the pulsed transmission.

5. A target sensor as set forth in claim 4 together with a ballistic body stored within the projectile and oriented in confronting vertical relationship to the target when the position of the projectile assumes preselected values of target range and angle as measured by the signal processing means.

6. The sensor set forth in claim 5 together with means connected between the processing means and fins of the projectile for adjusting the position of the fins to slow the rate of projectile spin so as to achieve the preselected projectile orientation when the missile approaches a target.

7. The sensor set forth in claim 6 wherein the ballistic body is a self-forging fragment.

8. A method for positioning a projectile bearing a ballistic body over a target, the method comprising the steps:

transmitting a radar interference beam pattern from the projectile toward the ground in order to detect a target;

receiving ground reflections in the projectile, in response to the transmitted beam;

movement of the interference beam across the target causing detectable modulation of a receive interference pattern; and detecting the modulation indicative of a target; and adjusting the roll position of the projectile to a preselected orientation wherein a ballistic body stored in the projectile is oriented in vertical confronting relationship to the target.

9. The method set forth in claim 8 together with the step of adjusting projectile fins to slow the rate of projectile spin when the missile approaches the target.

10. A method for positioning a projectile bearing a self-forging fragment over a target and comprising the steps:

transmitting a broad fan beam from a pair of antennas mounted to the projectile, the beam containing a pluality of closely spaced interference lobes, said lobes being spaced so as to encompass a predetermined target size;

receiving echo signals at the projectile which are indicative of a detectable target;

continuously varying the position of the interference lobes;

developing sum and difference signals from signals received by the antennas;

generating sum and difference intermediate frequency signals;

demodulating the sum and difference intermediate frequency signals;

measuring the ratio of the sum and difference signals to provide an output signal representing the angle between the projectile and a target;

pulsing the projectile transmitter for enabling target range to be determined from echo time measurements of the pulsed transmission;

reducing the projectile spin to zero when the projectile approaches the target; and orienting a self-forging fragment in the projectile in confronting vertical relationship to the target; and firing the fragment from the projectile when the projectile is located above the target.

11. The method set forth in claim 10 together with the step of adjusting the position of projectile fins to slow the rate of projectile spin so as to orient the fragment in confronting vertical relationship to the target.

12. The method set forth in claim 10 wherein the step of reducing the projectile spin to zero depends upon measuring the projectile spin period by detecting the corresponding period of radar received alternating terrain and sky radar returns.

* * * * *